US005566139A

United States Patent [19]

Abshire

[11] Patent Number: 5,566,139

[45] Date of Patent: Oct. 15, 1996

[54] PICOSECOND RESOLUTION SAMPLING TIME INTERVAL UNIT

[75] Inventor: James B. Abshire, Ellicott City, Md.

[73] Assignee: The United States of America as represented by the United States National Aeronautics and Space Administration, Washington, D.C.

[21] Appl. No.: 123,947

[22] Filed: Sep. 20, 1993

[51] Int. Cl.[6] ..... G04F 8/00

[52] U.S. Cl. ..... 368/118; 368/119; 368/120

[58] Field of Search ..... 368/118–120

[56] References Cited

U.S. PATENT DOCUMENTS 3,444,462 5/1969 Tarcy-Hornoch ..... 368/120
4,362,394 12/1982 Menlove .
4,637,733 1/1987 Charles et al. .
4,678,345 7/1987 Agoston .
5,027,298 6/1991 Khazam .

*Primary Examiner*—Bernard Roskoski
*Attorney, Agent, or Firm*—Robert D. Marchant

[57] ABSTRACT

A time interval unit which operates in accordance with electronic sampling techniques and employing a pair of identical sampling interpolators which are respectively triggered at the start and stop of the time interval to be measured. Each time interval unit includes a GHz frequency sinusoidal clock signal generator and a time counter in the form of a pulse counter and a pair of sampling type interpolators which are respectively triggered on in response to a start and a stop signal. When triggered, each interpolator samples the instantaneous amplitude of the in-phase(x) and quadrature(y) components of the sinusoidal clock signal. From the samples of the x and y components and the pulse counter's result, the elapsed time between two events is computed to a psec accuracy.

15 Claims, 4 Drawing Sheets

PICOSECOND RESOLUTION SAMPLING TIME INTERVAL UNIT

ORIGIN OF THE INVENTION

This invention was made by an employee of the United States Government and therefore may be made and used by and for the Government for governmental purposes without the payment of any royalties thereon or therefor.

BACKGROUND OF THE INVENTION

This invention relates generally to apparatus for measuring time and more particularly to an electronic time interval unit.

Time interval units are generally known and comprise electronic apparatus wherein an unknown time interval is measured between a start and a stop signal input. Time interval units typically include three parts including a coarse counter, a start interpolator and a stop interpolator. Most conventional time interval units measure time with a resolution finer than the coarse clock period and their performance is dictated by the performance of the interpolators. The interpolators of conventional time interval units normally involve one of two basic techniques. The first is a charge-discharge technique wherein a capacitor is charged and discharged at a constant rate, while the second uses an offset frequency technique and is analogous to a vernier time measuring device similar to that utilized in mechanical measurement tools.

With respect to charge-discharge type of time interpolation, one must accurately detect a zero crossing of the discharge ramp; however, this is susceptible to perturbations on the ramp and sensing the zero crossover point. Furthermore, charge and discharge ramps typically include harmonic frequencies with fixed amplitude and phase relationships. Real electrical circuits have non-ideal frequency and phase responses which result in less than ideal ramp waveforms which deviate from the average straight line which is desired.

As to the offset frequency type of time interpolation unit, it involves the use of a triggered oscillator utilized together with a fixed clock signal generator. The triggered oscillator must always start with low time jitter and with a fixed phase value. This starting phase can be influenced by noise from the trigger or by cross talk from the main oscillator. The performances of the frequency type time interpolator can never be better than the time jitter in starting the oscillator.

Accordingly, each of these known prior art approaches have inherent limitations which limit their resolution and accuracy.

SUMMARY

Accordingly, it is an object of the present invention to provide improvement in apparatus for measuring time intervals.

It is a further object of the invention to provide an improvement in apparatus which are known as time interval units.

It is another object of the invention to provide time interval units which have improved time resolution.

It is still another object of the invention to provide an improvement in time interval units which employ semiconductor integrated circuit sampling technology for improved accuracy.

The foregoing and other objects are achieved by a time interval unit which operates in accordance with electronic or optical sampling techniques and one which employs a pair of identical sampling interpolators which are respectively triggered at the start and stop of the time interval to be measured. Each time interval unit includes a GHz frequency sinusoidal clock signal generator and a time counter in the form of a pulse counter and a pair of sampling type interpolators which are respectively triggered in response to a start and a stop signal. When triggered, each sampling interpolator samples the instantaneous voltage of the in-phase (x) and quadrature (y) component of the clock signal. The output from the clock signal generator can be expressed as a vector rotating at the clock frequency. A two-channel semiconductor sampling head, typically fabricated in gallium arsenide circuit technology, outputs the sampled x and y components of the clock signal. The sampled values are fed to a computational circuit which computes $\Theta=\tan^{-1}(y/x)$ or $\Theta=\mathrm{ctn}^{-1}(x/y)$. The angle $\Theta$ corresponds to the instantaneous phase of the clock at the sample time. The unknown time offset from the last clock pulse to the trigger point is then determined by the expression $\tau=T(\Theta/2\pi)$ where T is the clock period and equal to 1/f, and f is the clock frequency. The total elapsed time interval At is measured according to the relation $\Delta t=nT+t2-t1$, where t1 is the time between the 0th coarse clock pulse and the start pulse and t2 is the time between the nth coarse clock pulse and the stop pulse.

BRIEF DESCRIPTION OF THE DRAWINGS

The following detailed description of the invention will be more readily understood when considered in conjunction with the accompanying drawings wherein.

DETAILED DESCRIPTION OF THE INVENTION

Before considering the details of the subject invention, additional discussion of the prior art will now be provided.

Figure 1:
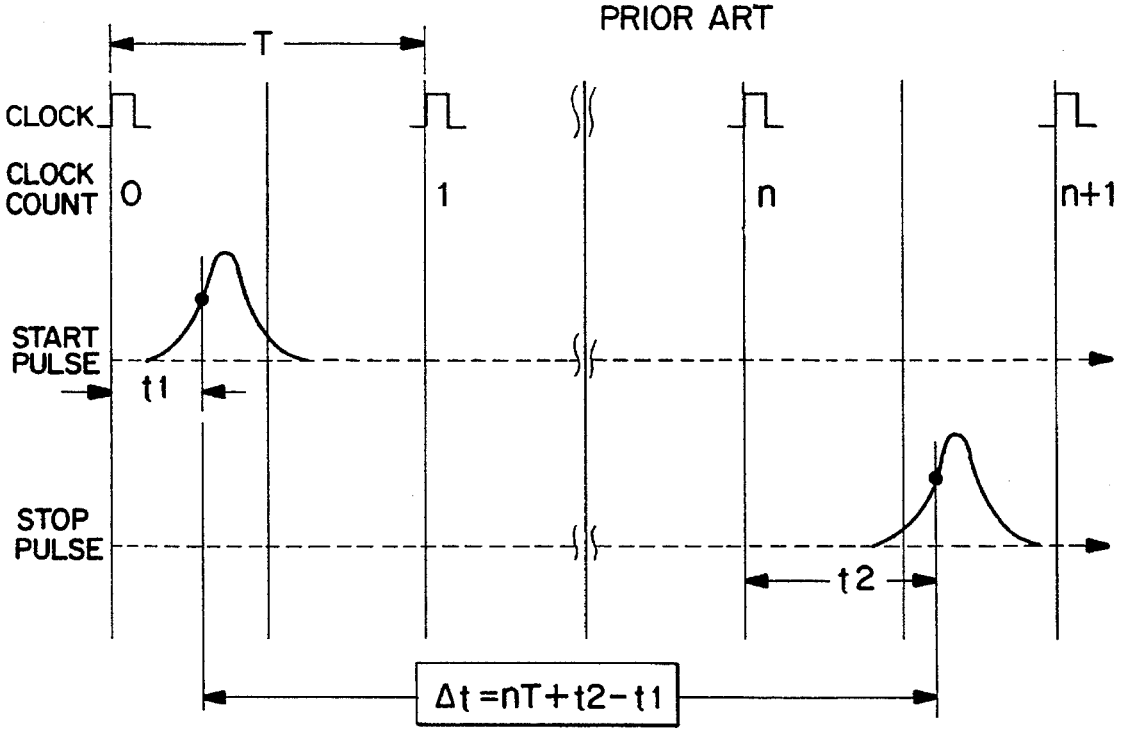
FIG. 1 PRIOR ART
FIG. 1 is a time related waveform diagram illustrative of the operation of conventional time interval units.

All time interval units, hereinafter referred to as TIUs, are based on a similar operational concept which is illustrated in FIG. 1. As shown, a clock signal depicted in the form of discrete rectangular pulses are used to quantify an unknown time interval $\Delta t$ between a start and a stop pulse to within one clock pulse cycle. The clock has a fixed frequency f typically 50 MHz and thus a period T=1/f which is 20 nsec.

Accordingly, the unknown time At as shown in FIG. 1 can be expressed as:

$$\Delta t = nT + t2 - t1 \quad (1)$$

wherein n is the number of coarse clock pulses between the start and stop pulse, tl is the time between the 0th clock pulse and the start pulse, and t2 is the time between the nth clock pulse and the stop pulse.

Figure 2:
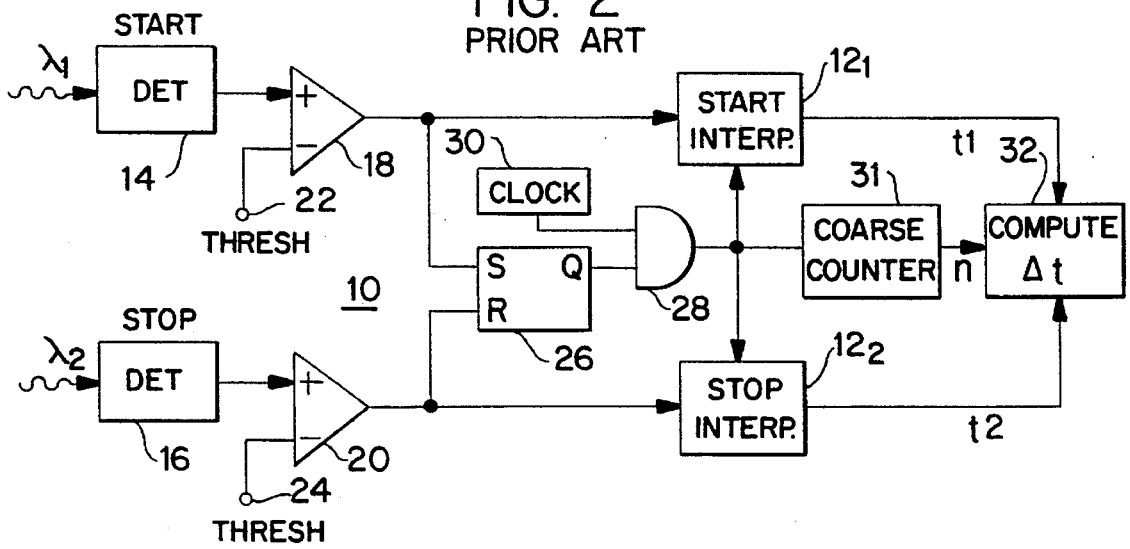
FIG. 2 PRIOR ART
FIG. 2 is an electrical block diagram of a typical time interval unit.

Special timing circuits, referred to as time interpolators, are used to measure the times tl and t2. Such circuits, as shown in FIG. 2, are used in a typical TIU 10, where reference numerals $\mathbf{12}_1$ and $\mathbf{12}_2$ designate, for example, two identical interpolators, a "start" interpolator, and a "stop" interpolator, respectively. To time optical pulses, a start and a stop pulse such as shown in FIG. 1 are respectively generated by a pair of detectors 14 and 16 which are responsive to optical inputs $\lambda_1$ and $\lambda_2$ which are separated by a time $\Delta_t$. The output of the detectors 14 and 16 are fed to a pair of signal comparators comprised of threshold detectors 18 and 20 which have respective threshold voltages applied thereto via terminals 22 and 24.

The output of threshold detector 18 is commonly fed to the input of the start interpolator $\mathbf{12}_1$ and the S input of a flip-flop circuit 26. In like fashion, the output of the threshold detector 20 is commonly fed to the input of the stop interpolator $\mathbf{12}_2$ and the R input of the flip-flop 26. The Q output of the flip-flop 26 is fed to one input of an AND logic gate 28 whose other input comprises the output of a clock generator 30. The output of the AND gate 28 is commonly fed to the interpolators $\mathbf{12}_1$ and $\mathbf{12}_2$ as well as a coarse counter circuit 31. The outputs of the interpolators $\mathbf{12}_1$ and $\mathbf{12}_2$ comprise measures of the times t1 and t2 which are then combined with the coarse count n out of the counter 31 where a computation circuit 32 produces an estimate of the unknown time Δt in accordance with equation (1).

The performance of the TIU 10 is dominated by the errors in the time interpolating circuits $\mathbf{12}_1$ and $\mathbf{12}_2$. Almost all TIUs use identical interpolator types for their stop and circuits, although the interpolator design can differ from one manufacturer to another. In the best available time interval units, the rms errors in measuring t1 and t2 are from 14 to 20 psec, yielding errors in At ranging between 20 to 30 psec.

Figure 3:
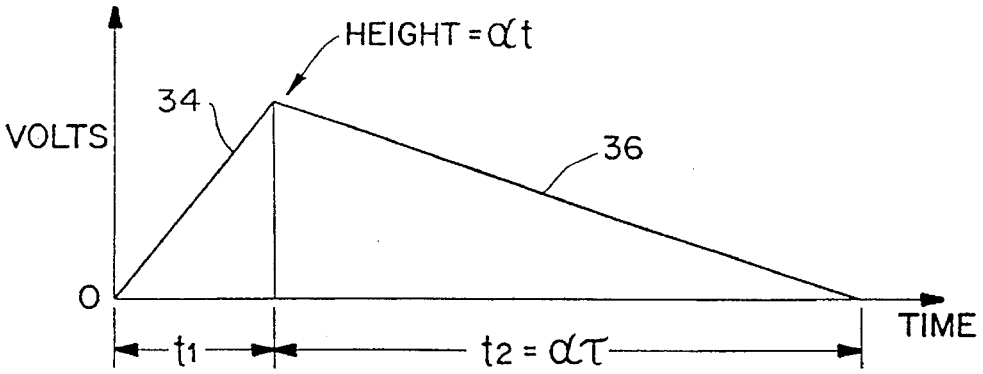
FIG. 3 PRIOR ART
FIG. 3 is a diagram illustrative of the operation of a charge-discharge time interpolator technique utilized in some conventional time interval units.

Conventional TIUs typically use "time stretching" interpolators of two basic types referred to above, one being a charge-discharge technique which is illustrated in FIG. 3. There a capacitor, not shown, is charged at the constant rate indicated by the straight line 34 during the time interval $\tau_1$ beginning at a first event, e.g. a clock pulse edge. The charging of the capacitor is stopped at tl and discharge starts at the second event, such as a start or stop pulse and is shown by the straight line portion 36. The ratio α of the charge rate to discharge rate is fixed, with values that range from typically 100 to 1000. Since the time for the discharge to reach 0 volts is $\tau_2 = \alpha\tau$, the interpolator estimates τ by multiplying the clock period by the number of clock pulses during the stretch time and dividing the result by α.

Figure 4:
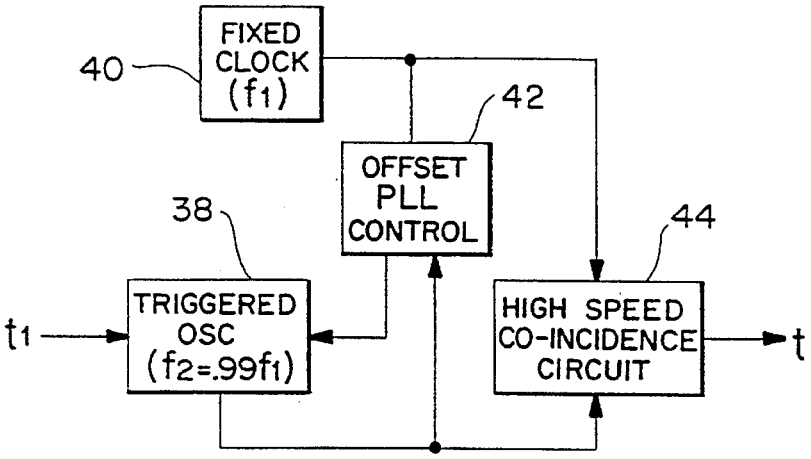
FIG. 4 PRIOR ART
FIG. 4 is an electrical block diagram illustrative of an offset frequency time interpolator technique used in other conventional time interval units.
Figure 5:
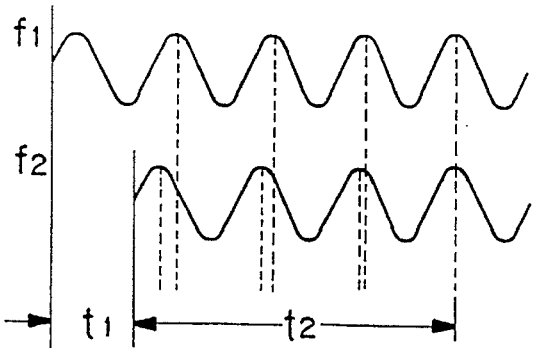
FIG. 5 PRIOR ART
FIG. 5 is a set of time related clock waveforms illustrative of the offset frequency technique embodied by the configuration shown in FIG. 4.

The second type of time "stretching" interpolator approach uses offset frequency techniques. It is an electrical analog of a vernier measuring device in mechanical measurement apparatus. Such an electrical configuration is shown in FIG. 4 and where the interpolator uses a triggered oscillator 38 in combination with a fixed clock signal generator 40. The oscillator 38 always starts with a given phase, but with a frequency f2 which is slightly less than the clock frequency $f_1$, e.g. $f_2 = 0.99 f_1$. This frequency relationship is provided by an offset phase lock loop (PLL) control circuit 42. Such interpolators measure the unknown time τ as shown in FIG. 5 by measuring the elapsed time t2 between the time of the external event $t_1$ and the time at which the main clock and the triggered oscillator frequencies $f_1$ and $f_2$ reach phase coincidence in a coincidence circuit 44. It can be shown that $$t_2 = nt_1 = t_1[f_1/(f_1 - f_2)] \quad (2)$$

and that $$\tau = t_2(f_1 - f_2)/f_1 \quad (3)$$

where $f_1$ is the main clock frequency, and $f_2$ is the interpolator's frequency.

The stretching constant for this type of interpolator is:

$$\alpha = f_1/(f - f_2) \quad (4)$$

Typical values of α for offset frequency interpolators range from 100 to 255.

There are inherent limitations in this type of apparatus which limit their timing performance, including: (1) main clock frequency; (2) charge-discharge interpolator limits; and (3) offset frequency interpolator limits.

With respect to main clock frequency, a coarse clock frequency $f_1$ of 50–100 MHz requires that the interpolators operate with total uncertainty ranges of 10 to 20 nsec. Timing resolutions of 10 to 20 psec require stretching ratios of α=1000 to 2000. Interpolator circuits with such large stretching ratios are susceptible to many disturbing effects, including noise, temperature drifts, and component aging. Small perturbations in any of these can cause significant errors in the respective time interval unit readings. Resolutions of 1 to 2 psec. would require the interpolator's α values to be ten times (×10) higher, which magnifies these errors proportionately.

As to charge-discharge interpolator limits, this approach must accurately detect a zero crossing of the slow discharge ramp. With the large required e values, this produces a shallow discharge ramp, which is very susceptible to slight perturbations on the ramp and "zero voltage" signals. Furthermore, both the charge and discharge ramps are comprised of many harmonic frequencies which must have fixed amplitude and phase relationships. Real electrical circuits have non-ideal frequency and phase responses, which result in non-ideal ramp waveforms that deviate from the desired straight lines. These deviations cause errors when determining the last zero crossing, and hence in the interpolated time τ.

With respect to offset frequency interpolation limits, this approach depends upon the accurate occurrence of several events. The triggered oscillator 38 must always start with low time jitter and with a fixed phase value. The starting phase can be influenced by noise from the trigger, or by cross talk from the main oscillator. The interpolator performance can never be better than the time jitter in starting the oscillator, which is a fundamental limit to this approach. The coincidence circuit 44 must also detect phase coincidence between the main clock $f_1$ and the triggered oscillator $f_2$, with a resolution on the order of 1°. This is difficult to do with the best available phase resolver circuits, and is susceptible to both noise and offset errors on the quadrature frequency components of the clock and triggered oscillator signals.

Where optical signals are encountered, in principle, streak cameras with electro-optic readouts could be used as interpolators for time interval units for optical signals. Their psec resolution could permit time interval measurements with very high accuracies. However, streak cameras have numerous practical limitations. They are large, fragile, relatively expensive, and require multi-kilovolt sweep circuits. Their sweep speeds are significantly non-linear, making psec level accuracies difficult to achieve in practice. Moreover, their sweep circuits have difficulty in qualifying for space operation. Also, their photo cathodes have a limited spectral response. This makes them unsuitable for use with 1 μm carriers of ND-YAG or ND-YLF lasers which are two of the most likely laser candidates in ranging systems.

Figure 6:
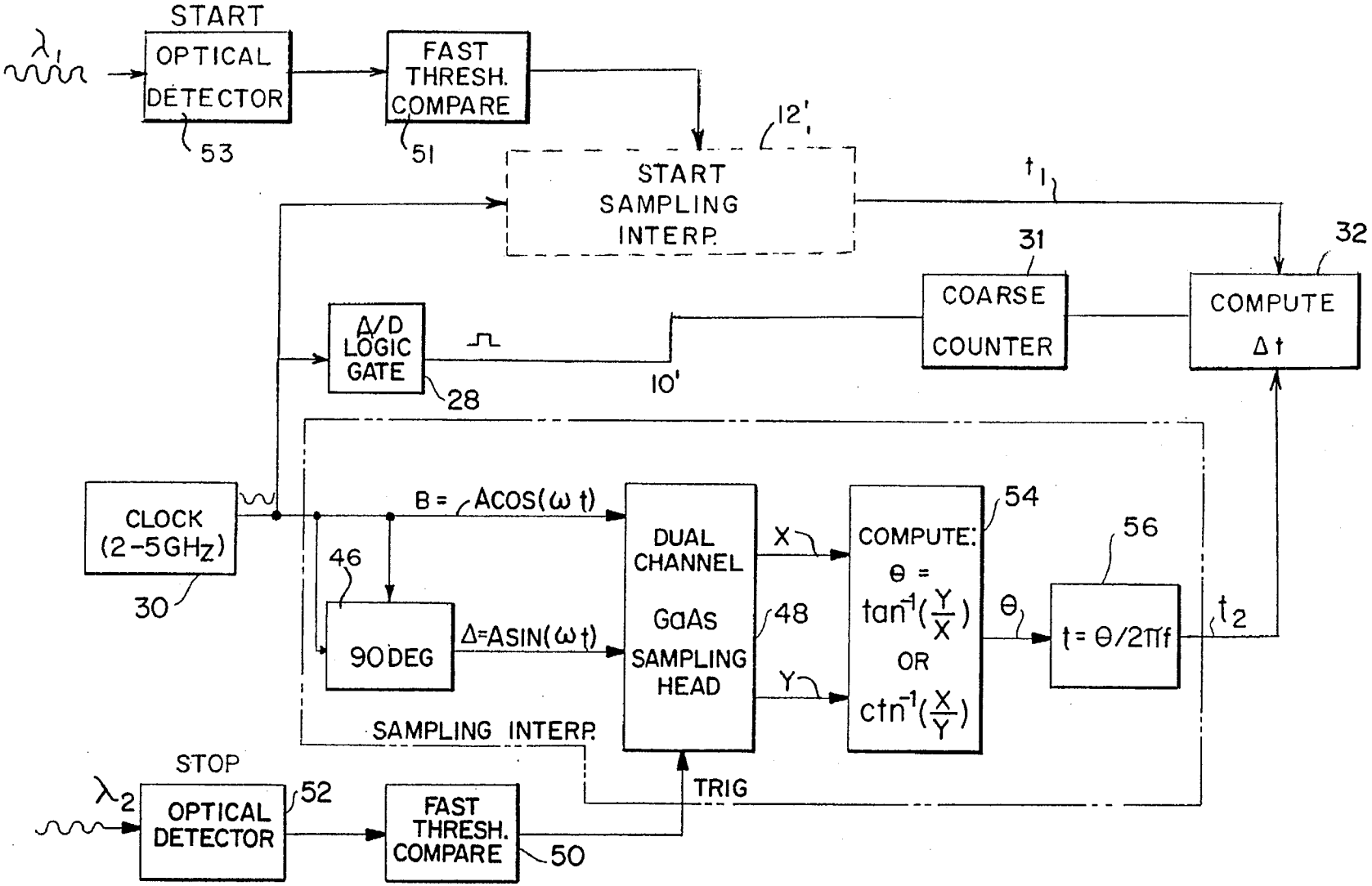
FIG. 6 is an electrical block diagram illustrative of the preferred embodiment of the invention.

Considering now the details of the subject invention, reference is now made to FIG. 6. Shown thereat is a block diagram of an improvement in the TIU 10 shown in FIG. 2 and comprising a TIU 10' including a pair of sampling interpolators $\mathbf{12'}_1$ and $\mathbf{12'}_2$ generating output signals corresponding to $t_1$ and $t_2$, respectively, from which Δt is computed in block 32, as before. Both sampling interpolators $\mathbf{12'}_1$ and $\mathbf{12'}_2$ are identical in construction and comprise start and stop interpolations, respectively; however, the details of the stop interpolator $\mathbf{12'}_2$are shown in FIG. 6 for purposes of illustration.

Figure 8:
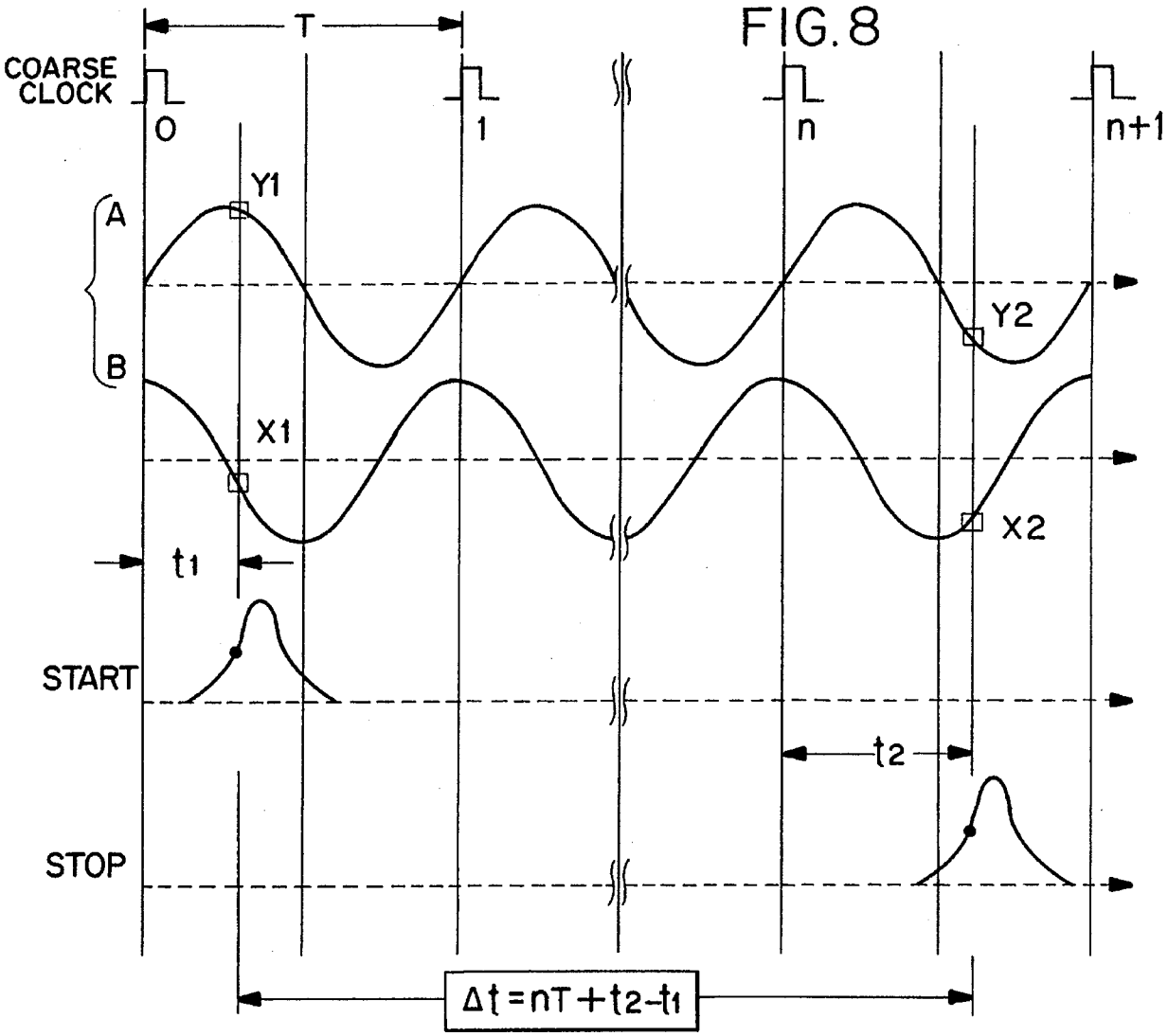
FIG. 8 is a time related pulse and waveform diagram illustrative of the operation of the embodiment shown in FIG. 6.
Figure 7:
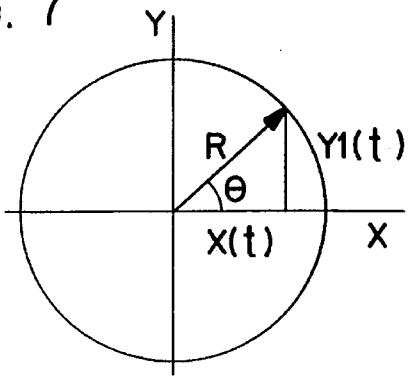
FIG. 7 is a vector diagram which represents the output from clock signal generator shown in FIG. 6.

A clock oscillator, typically operating in the range of 2–5 GHz, is required. Such clocks are commercially available. As shown, clock 30 such as depicted in FIG. 2, outputs a sinewave signal corresponding to a rotating vector as shown in FIG. 7 and is coupled to both interpolators $\mathbf{12'}_1$ and $\mathbf{12'}_1$ as well as to an analog to digital logic gate 28 which converts the clock signal to a digital logic gate 28 which in turn converts the clock signal to a digital pulse train. This pulse train is fed to the coarse counter 31. The real part of the signal, Acos(ωt), corresponds to the sinewave B shown in FIG. 8. The signal B is fed to a 90° phase shifter to provide a signal Asin(ωt) and corresponds to sinewave A shown in FIG. 8.

In FIG. 6, the two signals A and B are fed to a dual channel sampling head 48 of the stop sampling interpolator $\mathbf{12'}_2$. The sampling occurs upon a trigger input signal from a threshold comparator circuit 50 which is equivalent to one of the two comparator circuits 18 and 20 shown in FIG. 2. For example, the comparator circuit 50 is responsive to the output of an optical detector 52 which corresponds to the stop detector 16 shown in FIG. 2. The start sampling interpolator $\mathbf{12'}_1$ is responsive to the output of the fast threshold comparator 51 coupled to the start detector 53. Alternatively, the sampling heads in each sampling interpolator can be triggered with an electrical signal. The sampling head 48 shown in FIG. 6 is typically fabricated in Group III–V semiconductor material e.g. GaAs and therefore is able to respond to the 2–5 GH output frequency from the clock signal generator 44.

Considering the operation of interpolator $\mathbf{12'}_2$, upon receiving a trigger signal from the comparator 50, the sampling head 48 samples and holds the instantaneous voltage of sinewaves A and B and outputs two values x and y which are then fed to a computational circuit 54 which computes the expression:

$$\Theta=\arctan(y/x)\text{if}|X|>|y| \quad (5)$$

or $$\Theta=\text{arcctn}(x/y),\text{if}|X|<|y| \quad (6)$$

Either the tangent or cotangent functions are selected to minimize errors due to a small denominator term. The output of the computational circuit 54 is fed to a second computational circuit 56 which computes the term $t=\Theta/2\pi f$. Since the sampling interpolator $\mathbf{12'}_2$ shown in FIG. 6 is utilized as the stop interpolator $\mathbf{12'}_2$, the output of circuit 56 comprises a signal corresponding to $t_2$. In the same fashion the start sampling interpolator $\mathbf{12'}_1$ outputs a signal corresponding to $t_1$ and from which Δt can be computed in accordance with equation (1) in the block 32.

Thus by using sampling interpolators $\mathbf{12'}_1$ and $\mathbf{12'}_2$ (FIG. 6) of identical design in connection with both start and stop pulses in a TIU, time intervals of arbitrary length can be measured by counting the number of clock pulses n between start and stop pulses and combining their coarse time estimates with those of the interpolators.

It is to be noted that commercially available sampling leads have electrical bandwidths in excess of 20 GHz and sampling time jitters of several Psec. Their effective aperture time is only several Psec.

The error in a sampling type TIU can be estimated by considering the effects of fluctuations in the interpolator's trigger time and amplitude measurements. The sampling circuits used in 20–40 GHz bandwidth sampling oscilloscopes have time jitters of $\sigma(\Delta t)\approx 2$ psec. and amplitude jitters of a 2 mV per channel. To first order, these errors make independent contributions to the error in the timing estimate. The variance var(t) of the timing estimate can be written as:

$$var(t)=var(\Delta t)+(T/2\pi)^2 var(\Theta) \quad (7)$$

where $var(\Delta t)=\sigma^2(\Delta)$ is the variance of the sampling circuit time jitter.

The variance of the phase error caused by the amplitude errors in the x and y sampling heads is:

$$var(\Theta)\approx A^{-2}[var(\epsilon)+var(\delta)] \quad (8)$$

where A is the peak amplitude of the sampled sinewave, and ε and δ are the sampling errors for the in phase (x) and quadrature (y) channels, respectively.

For a typical sampling time interval unit in accordance with this invention, f=3.0 GHz, T=333 psec, A=300 mV and $\sigma(\epsilon)=\sigma(\delta)=2$ mV. The amplitude dependent part of the timing error can be found by evaluating the expressions above with these constants as shown in Table I which appears below.

TABLE 1

Amplitude Induced Timing Jitter for Sampling TIU

| | Avail. Components | Developmental |
|---|---|---|
| Input Parameters: | | |
| Sine Wave PeaK amplitude (mV) | 300 | 300 |
| Rms error in y samples (mV) | 2 | 1 |
| Rms error in x samples (mV) | 2 | 1 |
| Sine Wave Frequency (GHz) | 3 | 8 |
| Sine Wave Period (psec) | 333 | 125 |
| Single Channel Performance Calculation: | | |
| RMS error in phase estimate (mrad) | 9.428 | 4.714 |
| RMS error in phase estimate (deg.) | 0.540 | 0.270 |
| Rms Ampl.limited timing jitter(psec) | 0.500 | 0.094 |
| RMS 2 channel ampl. limited jitter(psec) | 0.707 | 0.133 |

This yields, for a single channel, an amplitude dependent error of:

$$\sigma 1(t)=0.5 \text{ psec} \quad (9)$$

In a single TIU measurement, the start and stop interpolators shown in FIG. 6 and implemented in a configuration such as shown in FIG. 2, contribute independent amplitude errors, so that, $$\sigma 2(t)=0.71 \text{ psec} \quad (10)$$

Since these amplitude induced timing jitters are less than $\sigma(\Delta t)=2$ psec, the timing error for the TIU will be dominated by the trigger jitters in the start and stop sampling intervals. For the embodiment shown, the overall TIU rms timing error is ≈3 psec. An electronic timer with this resolution provides an improvement in the range of at least ten (×10) over the present state-of-the-art using conventional approaches.

The last column in Table I summarizes the expected performance if modest improvements are made in clock frequency and the sampling amplitude jitter. With a 8 GHz clock and 1 mV amplitude jitter, the two channel amplitude jitter is reduced by a factor of five (×5) to:

$$\sigma 2(t)=0.13 \text{ psec} \quad (11)$$

This performance is a significant improvement in measuring time intervals. No currently known time interval units work better than 1 psec accuracy.

It should be noted that the foregoing has been made by way of illustration and not limitation. Accordingly, several modifications and variations may be resorted to when desirable. For example, one may use any combination of different interpolator waveforms, the number of sample values in each interpolator, multiple trigger points per start and stop signal, extending the sampling concept to still higher clock frequencies, and using different sampling technologies. While the preferred embodiment utilizes a sinewave as an interpolating function, any invertible waveform or function such as a triangular waveform can be used where its inverse can be calculated. The primary constraint on the waveform is that it permits the time interval unit to perform an unambiguous calculation of elapsed time from the sampled amplitude values.

If the sinewave were to be split into m channels, where m>two channels, the m channels can be used to sample the sinewave with a fixed time offset between the samples. The occurrence time $\tau$ of the trigger signal can be calculated by using the phase estimates from each of the m samples. One example would be using 3 channels spaced 120 degrees apart in phase. More samples can be used if necessary, or if they become desirable for a specific application.

If the trigger pulses do not have constant amplitude, the finite edge times of the trigger signals can cause timing errors known as "time walk". These errors can be compensated for by using two or more sampling circuits in each interpolator. One set of interpolators would be used to record the time $\tau_1$ of the pulse's crossing a low voltage threshold level, while a second would be used to record the time $\tau_2$ of the pulse's crossing of the higher voltage threshold. If the shape of the pulse is known, the time occurrence of any part of the pulse can be calculated from these two samples. More than two samples can be used to improve accuracy of the time walk correction.

While the present invention discloses the use of frequencies in the 2–5 GHz range, frequencies can also be used which are beyond the present technology limit of digital counter circuits. In such apparatus, the clock source would typically consist of two frequencies which are phase-locked together. For example, a microwave frequency pair of 20 and 22 GHz might be used. Since the error in the interpolator measurement is proportional to T=1/f, the higher clock frequency reduces the measurement error. The phase of both frequencies would then be sampled with a four channel sampling interpolator. The phase estimates of 20 and 22 GHz sine wave which are calculated in the interpolator, can be used to estimate on which cycle of the 20 GHz clock the samples occurred. Since the 20 and 22 GHz clocks are phase locked, the phase relationship between the two clocks repeats at a 2 GH difference frequency, digital counting circuits would be required to count only at the 2 GHz difference frequency. This same concept can be used to extend the frequency range if desired by using three or more phase-locked frequencies, each of which is sampled with sampling channels.

With respect to different sampling technologies, these can include using electro-optic sampling techniques to sample the instantaneous intensity of an optical waveform. The main requirement is that the sample offer sufficient amplitude and time resolution to permit the time interval unit to calculate elapsed time from the sampled values of the waveform.

The sampling type interpolator time interval unit approach has several advantages over the prior art. They include: (1) The use of extremely high bandwidth low time jitter circuit elements (GaAs sampling circuits) for precise timing applications. No presently available TIU technique permits the capabilities of these uniquely accurate circuit elements to be used for precision timing applications; (2) Time stretching interpolators can be eliminated. The conventional approaches are susceptible to many effects, such as noise or base line drifts. The sampling approach works for signals with much faster slopes, and is significantly less susceptible to these types of errors; (3) Fixed frequency interpolating functions (i.e. sinewaves) can be used. These functions are significantly less susceptible to bandwidth distortions and noise than are the ramp waveforms of conventional charge-discharge time stretching interpolators; (4) Much higher frequency i.e. (≧2 GHz) clocks can be used. This permits the sampling interpolator to work over a smaller dynamic range in time and thus permits higher timing accuracy; (5) The sampling time interval unit approach is straight forward, resulting in simplicity of design with only the sampling circuits operating with high electrical bandwidths; (6) The timing accuracy is enhanced, permitting measurements to be made to a few psec which is in the order of magnitude more than accurate conventional time interval units; (7) The sampling approach can be extended to optical sampling of either electrical or optical waveforms which would permit sub-psec timing resolution.

Having thus shown and described what is at present considered to be the preferred embodiment of the invention, it should be noted that all equivalents, modifications and variations coming within the spirit and scope of the invention as set forth in the appended claims are herein meant to be included.

I claim:

1. A time interval unit for measuring the elapsed time between a first and second detected event, comprising:

clock signal generator means for generating a periodic amplitude varying clock signal;

means for converting the clock signal to a digital pulse train;

counter means responsive to said digital pulse train for generating a count n of the number of pulses of said digital pulse train occurring between said first and second events;

means for detecting said first and second events and generating start and stop signals, respectively;

a first time interpolator responsive to said clock signal and said start signal for generating a signal corresponding to the elapsed time tl between a pulse of said pulse train occurring immediately prior to said start signal and the start signal itself;

a second time interpolator responsive to said first clock signal and said stop signal and generating a signal corresponding to the time t2 between a pulse of said pulse train occurring immediately prior to the stop signal and the stop signal itself;

said first and second time interpolators comprising like sampling time interpolators, each using said clock signal as a rotating vector type signal, and including means for sensing the in-phase(x) and quadrature(y) components of said vector type signal and calculating a phase $\Theta$ of the clock signal in response to the start and stop signal, respectively, from the expression $\Theta$=arctan (y/x) or arcctn (x/y), and from which the times t1 and t2 are determined from the expression $t=T(\Theta/2\pi)$, where T is the period between said clock signal; and means responsive to the count n of pulses of said digital pulse train for determining the time $\Delta t$ between said first and second detected events from the expression $\Delta t=nT+t2-t1$.

2. The time interval unit according to claim 1 wherein said periodic amplitude varying clock signal comprises at least one sinusoidal clock signal.

3. The time interval unit according to claim 2 wherein said means for sensing includes means for sampling the clock signal in response to said start and stop signals.

4. The time interval unit according to claim 3 wherein said sampling means comprises amplitude sensing means.

5. The time interval unit according to claim 4 wherein said sampling means includes means for optically sensing the periodic amplitude varying clock signal.

6. The time interval unit according to claim 5 wherein said means for optically sensing includes laser sensing means.

7. The time interval unit according to claim 4 wherein said sampling means comprise a sampling head fabricated in Group III–V semiconductor material.

8. The time interval unit according to claim 7 wherein said sampling head is fabricated in gallium arsenide.

9. The time interval unit according to claim 2 wherein said means for sampling comprises means for multiple sampling of the clock signal.

10. The time interval unit according to claim 1 wherein said means for detecting comprises means for generating a plurality of start signals spaced apart in a predetermined amplitude sequence and a plurality of stop signals also spaced apart in a predetermined amplitude sequence.

11. The time interval unit according to claim 1 wherein said clock signal generator means operates in the GHz frequency range.

12. The time interval unit according to claim 1 wherein said clock signal generator means generates a clock signal comprising a plurality of frequencies which are phase locked together.

13. The time interval unit according to claim 1 wherein each of said first and second time interpolators includes means for sensing plural in-phase(x) and quadrature(y) components of said vector type signal and means for computing the elapsed time between said plurality of components.

14. The time interval unit according to claim 1 wherein said clock signal comprises at least two mutually offset time related sinusoidal clock segments utilized in separate channels.

15. The time interval unit according to claim 1 wherein said amplitude varying clock signal comprises a triangular type clock signal.

* * * * *